US007828293B1

(12) United States Patent
Pruzan et al.

(10) Patent No.: US 7,828,293 B1
(45) Date of Patent: Nov. 9, 2010

(54) SEEK AND FIND GAME WITH SHIFTING THREE-DIMENSIONAL UNDERLAY

(76) Inventors: Alan Pruzan, 1100 Denny Way, Seattle, WA (US) 98109; Andrew Forrest, 1100 Denny Way, Seattle, WA (US) 98109; Jay Wheatley, 1100 Denny Way, Seattle, WA (US) 98109

( * ) Notice: Subject to any disclaimer, the term of this patent is extended or adjusted under 35 U.S.C. 154(b) by 4 days.

(21) Appl. No.: 12/475,586

(22) Filed: May 31, 2009

(51) Int. Cl.
*A63F 3/00* (2006.01)

(52) U.S. Cl. ..... 273/139; 273/236; 273/457

(58) Field of Classification Search ..... 273/236, 273/273, 287, 139, 140, 153 R, 156, 457; 40/409
See application file for complete search history.

(56) References Cited

U.S. PATENT DOCUMENTS 3,077,697 A * 2/1963 Fry ..... 446/155
3,311,226 A 3/1967 Oliver
3,649,024 A * 3/1972 Katzman ..... 273/273
4,487,585 A * 12/1984 Goldwasser ..... 434/259
4,822,051 A * 4/1989 Nowak et al. ..... 273/157 R
5,050,882 A * 9/1991 Yang ..... 273/144 B
5,328,173 A * 7/1994 Stern ..... 273/144 B
5,580,054 A * 12/1996 Shneifer ..... 273/138.1
5,657,991 A * 8/1997 Camarato ..... 273/269
5,803,458 A * 9/1998 Snyder ..... 273/273
5,823,532 A * 10/1998 Goldwasser et al. .... 273/157 R
6,105,790 A * 8/2000 Parks ..... 211/42
6,382,629 B1 * 5/2002 Hill ..... 273/303
6,447,395 B1 * 9/2002 Stevens ..... 463/18
7,665,732 B2 * 2/2010 Stephens ..... 273/139

* cited by examiner

*Primary Examiner*—William M Pierce
(74) *Attorney, Agent, or Firm*—LaMorte & Associates

(57) ABSTRACT

A game assembly and its method of play. The game assembly has a game board. A three-dimensional underlay is positioned under the game board. Openings are formed through the game board that enable a person to see into the underlay. The underlay is comprised of a basin that is partially occupied with fill material. Search objects are mixed with the fill material. Sometimes the search objects are covered by the fill material, at other times they are not. Cover structures are provided. The cover structures selectively cover the openings in the game board. To play the game, a player selects a search object. A player also selects a cover structure. The cover structure selected by the player is removed and the player looks through the exposed opening for the selected search object. The game is won when a predetermined number of search objects are found by a single player.

18 Claims, 3 Drawing Sheets

SEEK AND FIND GAME WITH SHIFTING THREE-DIMENSIONAL UNDERLAY

BACKGROUND OF THE INVENTION

1. Field of the Invention

In general, the present invention relates to games where the purpose of the game is to find a hidden object. The present invention also relates to games where objects are mixed amongst fill material, wherein hidden objects become visible when the fill material is agitated.

2. Prior Art Description

The prior art is replete with board games where different objects are hidden behind doors, flaps or in similar compartments on the playing board. The problem with seek and find games having compartments is that once a child plays the game, the child becomes familiar with the location of the hidden objects and the game quickly loses its novelty. In certain seek and find games, cards and other exchangeable items are hidden in the compartments. This prevents players from knowing what objects are hidden in the various compartments. However, in such seek and find games, a person must place the varying items within the different compartments. As such, either a person who is not playing the game must be enlisted to set up the game, else one of the players will know what objects are hidden and where. Some games, such as Cranium Cariboo™ by Hasbro of Pawtucket, Rhode island use ball-shaped objects that automatically intermix. However, for most game types, the varying of objects in compartments remains a large problem.

In recent years, there has been a resurgence in seek and find games, where small objects are mixed in among a much larger volume of granular fill, such as sand or beads. The mixture is held in a container having at least one transparent section. The various objects become hidden among the fill. Those objects are then searched for by shaking or squeezing the container in order to agitate the fill. Seek and find games that hide objects among a granular fill have been in existence for over one-half century and are exemplified by U.S. Pat. No. 3,311,226 to Oliver, entitled Advertising Display Can. A current poplar seek and find game is Find-it™, distributed by Find-it Games, Inc of Snohomish, Wash.

In the present invention, elements of seek and find granular fill games are used as an underlay for a compartment seek and find game. The two technologies complement each other to produce a game where the contents in a compartment can be kept unknown even if the game is set up by the players. The structure of the new game and its associated method of play are described and claimed below.

SUMMARY OF THE INVENTION

The present invention is a game assembly and its corresponding method of play. The game assembly has a game board. A three-dimensional underlay is positioned under the game board. A plurality of openings are formed through the game board that enable a person to see into the underlay. The underlay is comprised of a basin that is partially occupied with fill material. Accordingly, at least some of said fill material is viewable in the basin through each of the openings in the game board.

A plurality of search objects are mixed with the fill material. Sometimes the search objects are covered by the fill material, at other times they are not. As a result, different search objects can be viewed through the different openings. The search objects that can be seen through each of the openings vary each time the underlay is shaken.

A plurality of cover structures are provided. The cover structures selectively cover the openings in the game board. To play the game, a player selects a search object. A player also selects a cover structure. The cover structure selected by the player is removed and the player looks through the exposed opening for the selected search object. The game is won when a predetermined number of search objects are found by a single player.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention game can be embodied in many ways, the embodiment illustrated shows the game in a simple configuration with five viewing windows. This embodiment is selected to simplify the drawings, description, and understanding of the game structure and its method of play. The illustrated embodiment, however, is merely exemplary and should not be considered a limitation when interpreting the scope of the appended claims.

Figure 1:
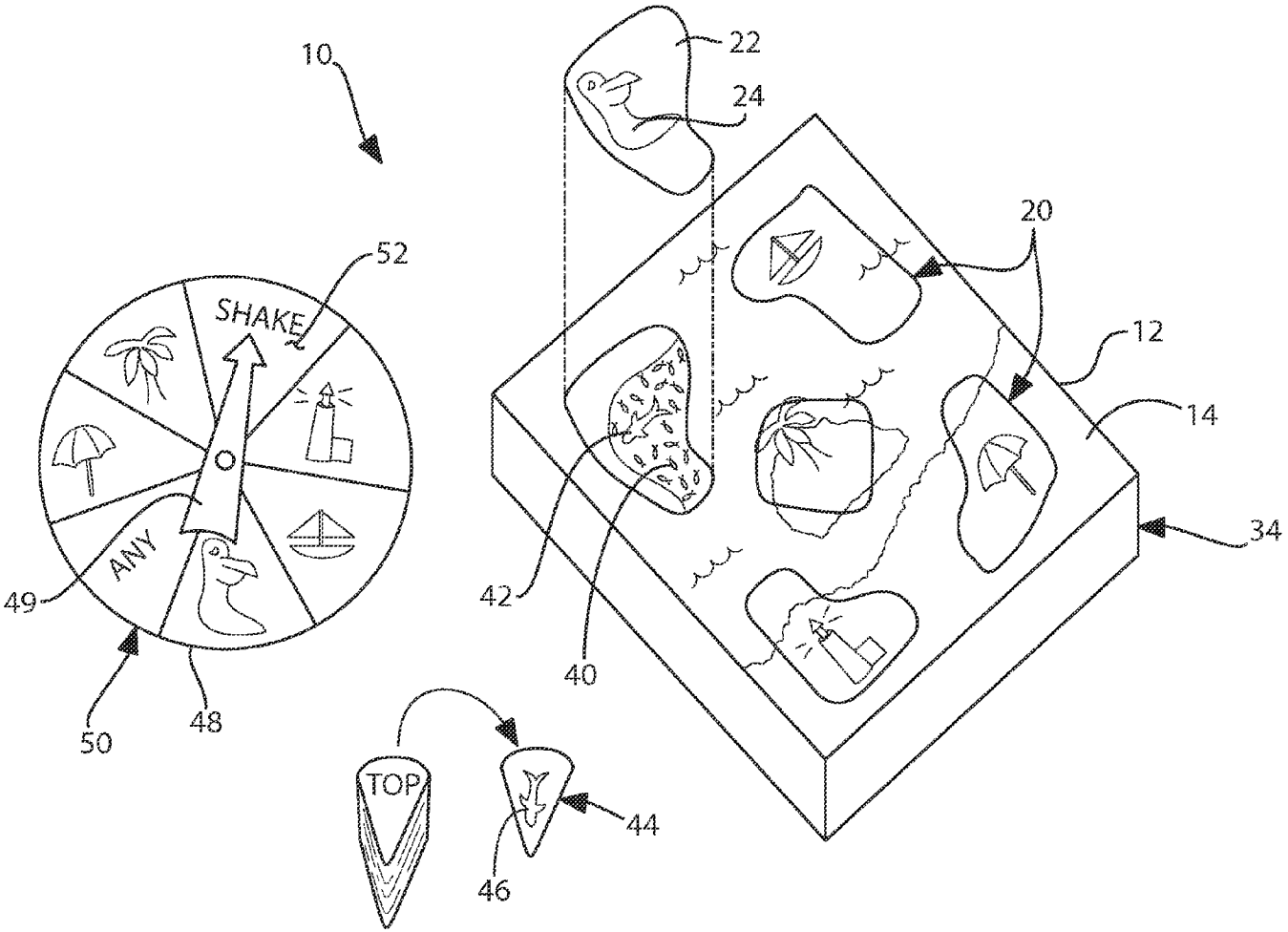
FIG. 1 is a perspective view of an exemplary embodiment of a game assembly.
Figure 2:
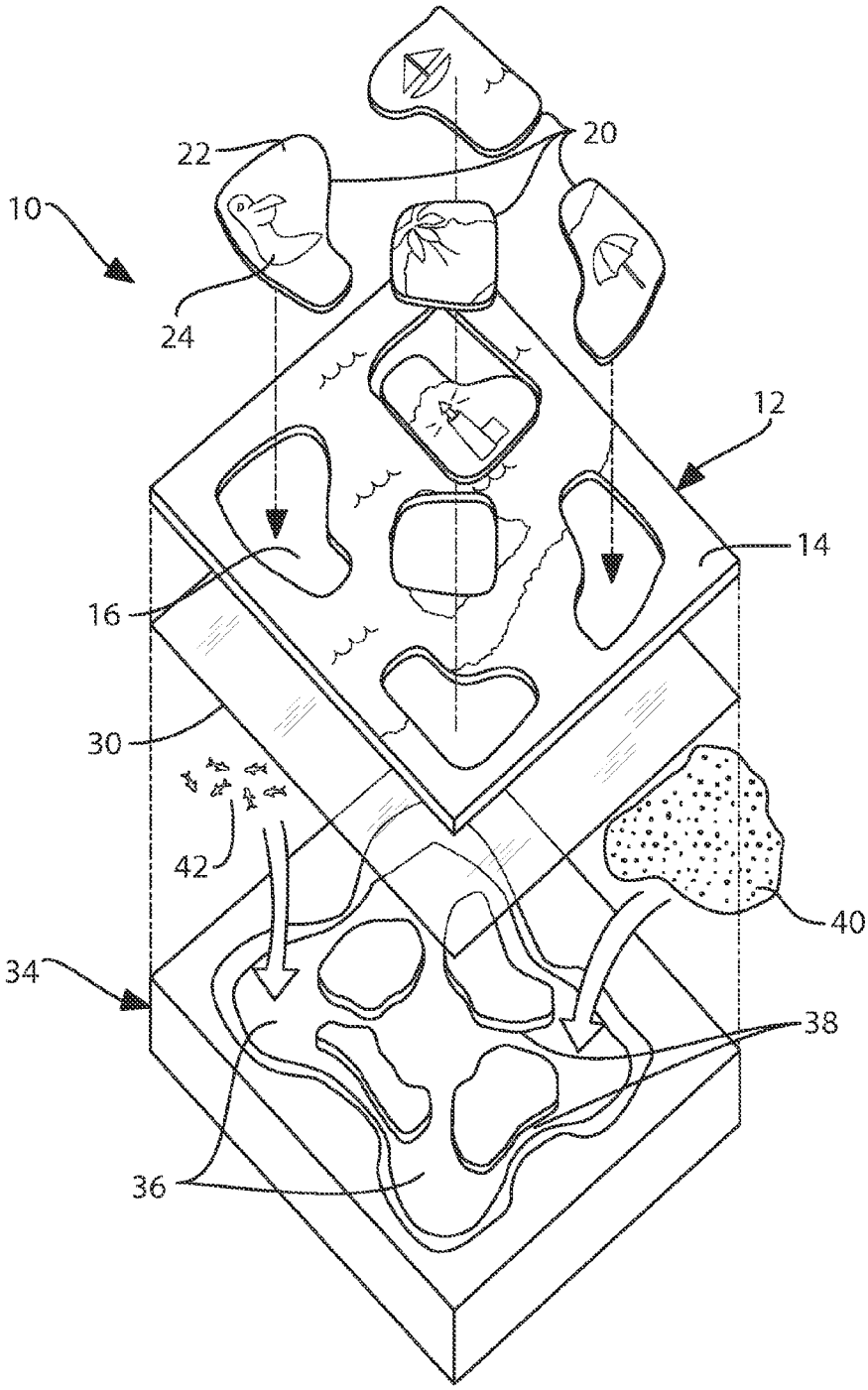
FIG. 2 is an exploded view of the exemplary embodiment of FIG. 1.

Referring to FIG. 1 and FIG. 2, the structure of the present invention game assembly 10 is shown. The game assembly 10 includes a game board 12. The game board 12 has a top surface 14. A plurality of openings 16 are formed through the game board 12, therein enabling a person to see below the game board 12. In the shown embodiment, five separate openings 16 are present on the game board 12. However, it will be understood that the game assembly 10 can employ any plurality of openings 16.

A cover structure 20 is provided for each of the openings 16 that is used to selectively cover the various openings 16. The cover structures 20 can be removable panels 22, such as is illustrated. However, the removable cover structures 20 can be doors, flaps, three-dimensional objects or any other opaque item that can be used to temporarily cover the openings 16. For instance, the cover structures 20 can be shaped as trashcans, treasure chests, gift boxes or any other such object, depending upon the selected theme for the game.

In the shown embodiment, the cover structures 20 are flat panels 22. Graphics 24 are printed on the panels 22. Complementary graphics 26 are also printed on the top surface 14 of the game board 12. Each panel 22 has as an identifying graphic 24. In the shown embodiment, the identifying graphics 24 for the five panels 22 include a beach umbrella, a lighthouse, a boat, a bird, and a palm tree. If three-dimensional cover structures 20 are used, graphics need not be used. Rather, the cover structure 20 itself can be formed into a unique identifiable shape, thereby serving the same visual purpose as would printed graphics.

A transparent barrier 30 is placed under the game board 12. The transparent barrier 30 extends over each of the openings 16 in the game board 12, therein creating windows 32 that enable a person to see through the game board 12. One large transparent barrier may be used, or multiple smaller transparent barriers. What is of importance is that each opening 16 is covered by a transparent barrier 30.

A contoured basin 34 is provided. The basin 34 contains a plurality of depressed areas 36. The depressed areas 36 are positioned under the various openings 16 in the game board 12. As such, each of the depressed areas 36 can be seen through the transparent barrier 30 that covers the openings 16 in the game board 12. Channels 38 are formed in the basin 34 that interconnect all of the various depressed areas 36.

A volume of granular fill material 40 is provided. The granular fill material 40 can be sand, seeds or any other collection of granular material. However, the fill material 40 is preferably small beads of plastic. The fill material 40, if plastic, can be molded in a color complementary to the theme selected for the game. For example, the shown exemplary embodiment of the game assembly 10 has a beach theme. The fill material 40 can therefore be colored in the tans and pinks of sand or in the blues, greens and whites of water. The fill material 40 is preferably provided in such a volume that the fill material 40 can fill at least half of all the depressed areas 36 simultaneously.

A plurality of search objects 42 are provided. The search objects 42 are mixed in with the fill material 40. The search objects 42 are again made to the theme of the overall game assembly 10. Since the exemplary embodiment has a beach theme, the search objects 42 would be small representations of items commonly found at the beach, such as seashells, buckets, shovels, crabs and the like. The search objects 42 can be made from any material, but are preferably plastic so that the density of the search objects 42 is generally equal to that of the fill material 40.

The various search objects 42 are sized so as to be significantly larger than the fill material 40, yet small enough to be fully buried by the fill material 40 in any of the depressed areas 36. It is also preferred that each of the search objects 42 be brightly colored in one of a few selected colors.

A deck of playing cards 44 is provided. The playing cards 44 are used as a random selector for the search objects 42. On the back of each playing card 44 is a graphic 46 that identifies a search object 42 or identifies a characteristic of multiple search objects 42. For example, one card may show a picture of a bucket. Another card may show just the color red, a characteristic of many search objects 42. In the shown embodiment, each card 44 is shaped as a pie wedge. Such a shape is merely exemplary and it will be understood that the cards 44 can have any geometric shape.

Another random selector 50 is provided. In the shown embodiment, the second random selector 50 is a chance wheel 48 with a spinning arrow 49. However, other random selectors such as dice can be used. The chance wheel 48 is divided among a plurality of spaces 50. Graphics are printed on the spaces of the chance wheel 48. Most of the graphics correspond to the graphics and/or shape of the cover structures 20, i.e. the shown panels 22. In this manner, when the arrow 49 on the chance wheel 48 is spun, it is likely to come to rest pointing to a space 50 that identifies a cover structure 20. However, at least one space 52 on the chance wheel 48 is identified with graphics that instruct a player to disrupt the underlay of the game board 12.

Figure 3:
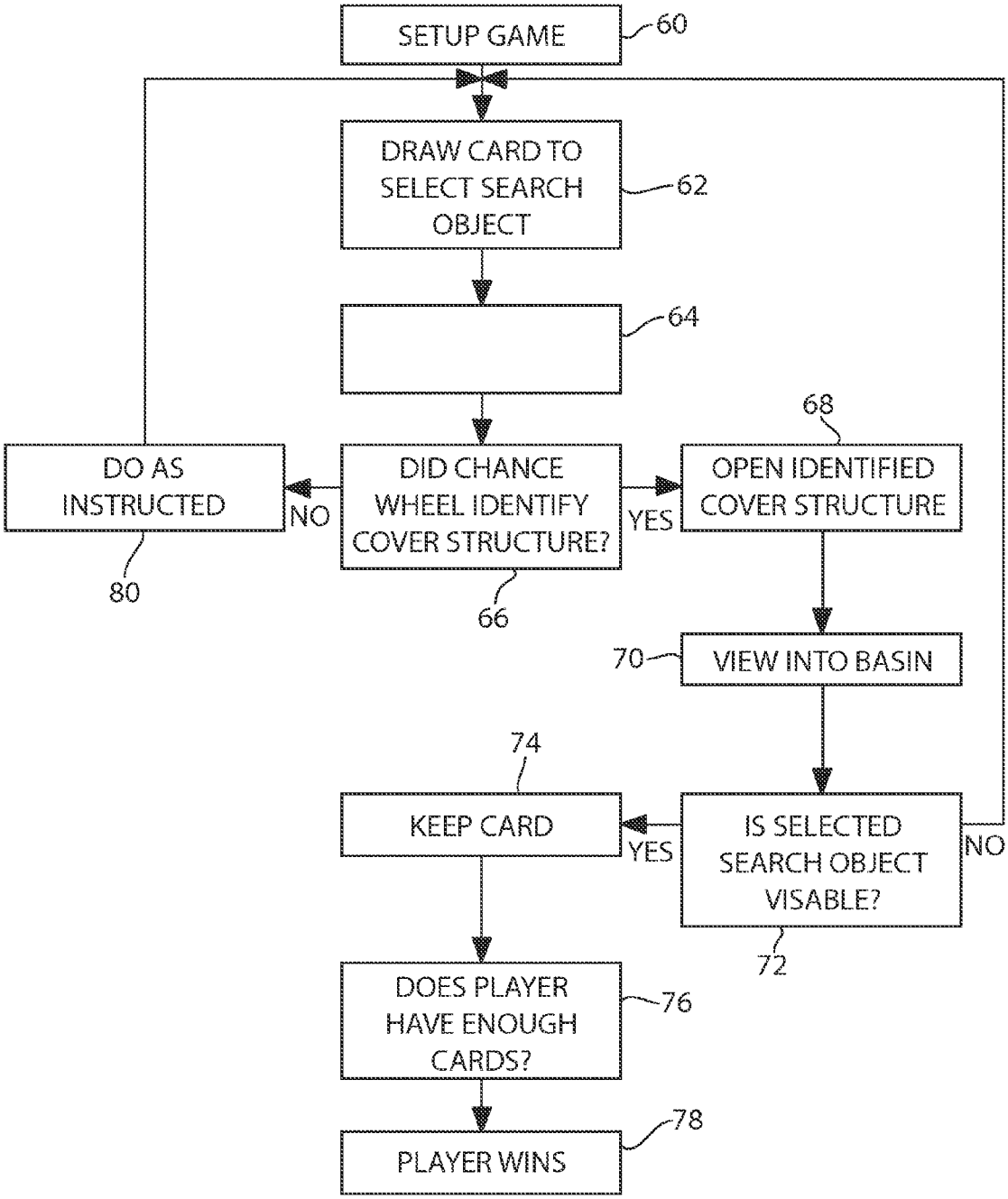
FIG. 3 is a block diagram explaining an exemplary method of play.

Referring to FIG. 3 in conjunction with both FIG. 1 and FIG. 2, the method of play for the game assembly can be described. As is indicated by Block 60, the game assembly is readied for play. To do this, the game board 12 and basin 34 are shaken and the cover structures 20 are placed over the openings 16 atop the game board 12. As the basin 34 is shaken, the fill material 40 and the search objects 42 move through the channels 38 between the depressed areas 36. Some search objects 42 are visible atop the fill material 40, other search objects 42 become buried under the fill material 40.

A player picks a card 44 from the deck of cards. See Block 62. The card 44 contains a graphic 46 that identifies one of the search objects 42 mixed with the fill material 40. The player then spins the arrow 49 on the chance wheel 48. See Block 64. If the arrow 49 lands on a space 50 that identifies a cover structure 20 on the game board 12, the player then opens that cover structure 20 on the game board 12. See Blocks 66 and 68. Once the cover structure 10 is removed, the player can see into one of the depressed areas 36 of the basin 34. Some of the search objects 42 will be visible within the basin 34. See Block 70. If the player sees the search object 42 that he/she is looking for, that player gets to keep the playing card 44. See Blocks 72 and 74. The first player to collect a predetermined number of cards wins. See Blocks 76 and 78.

If a player spins the arrow 49 on the chance wheel 48 and the arrow 49 stops on the space 52 that indicates the underlay should be shaken, then the entire game board and basin is lifted and shaken as instructed. See Blocks 80. This causes the fill material 40 and the search objects 42 in the fill material 40 to shift in and among the various depressed areas 36. The search objects 42 visible in each of the depressed areas 36, therefore, vary each time the game board 12 and basin 34 are shaken. Accordingly, a player can draw a card 44 that takes that player to the same cover structure 20 multiple times during a game. If the game assembly 10 has been shaken, the search objects 42 visible under that same cover structure 20 will differ.

It will be understood that the embodiment of the present invention that is illustrated and described is merely exemplary and that a person skilled in the art can make many variations to that embodiment. For instance, the graphics of the game can be changed to any desired theme. The shape of the game board, the cover structures, the openings, the basin, the search objects, the cards, and the random selector can all be changed as a matter of design choice by the manufacturer. All such embodiments are intended to be included within the scope of the present invention as defined by the claims.

What is claimed is:

1. A game assembly comprising:

a basin;

a game board defining a plurality of openings positioned proximate said basin, wherein defined areas within said basin are viewable through said openings;

a volume of granular fill material present in said basin wherein at least some of said fill material is viewable in said defined areas through said openings;

a plurality of search objects mixed with said fill material; and a plurality of cover structures for selectively covering said openings in said game board, wherein a cover structure is provided for each of said openings.

2. The assembly according to claim 1, wherein said defined areas of said basin are interconnected, therein enabling said fill material and said plurality of search objects to move between said defined areas when said basin is agitated.

3. The assembly according to claim 1, wherein depressions are present in said basin in said defined areas.

4. The assembly according to claim 3, wherein said depressions are interconnected by channels within said basin.

5. The assembly according to claim 1, wherein said granular fill material and said plurality of search objects have the same general material density.

6. The assembly according to claim 1, further including a piece of transparent material disposed between said openings and said basin to prevent said fill material and search objects from exiting said basin through said openings.

7. The assembly according to claim 1, further including playing cards, wherein each of said playing cards identifies at least one of said search objects.

8. The assembly according to claim 7, further including a random selection device for selecting one said cover structure from said plurality of cover structures.

9. The assembly according to claim 8, wherein said random selection device is a spin wheel.

10. A game assembly comprising:

a confined area viewable through a plurality of windows;

a plurality of removable cover structures for selectively covering said plurality of windows and preventing viewing of said confined area through said plurality of windows;

a mixture of dry fill material and discernable objects contained within said confined area;

a first selection device for randomly selecting from among said removable cover structures; and a second selection device for randomly selecting from among said discernable objects.

11. The assembly according to claim 10, wherein said second selection device is a deck of cards, wherein each card in said deck of cards contains graphics that identify at least one of said discernable objects.

12. The assembly according to claim 10, wherein said plurality of windows are all formed on a common flat surface.

13. The assembly according to claim 10, wherein said confined area contains depressions positioned under said plurality of windows.

14. The assembly according to claim 13, wherein said depressions are interconnected by channels.

15. The assembly according to claim 10, wherein said first selection device is a spin wheel.

16. A method comprising the steps of:

providing a basin partially filled with a mixture of granular material and search objects, wherein particular areas of said basin are viewable through windows;

selectively obstructing each of said windows;

randomly selecting one of said search objects;

randomly selecting one window from among said windows;

removing an obstruction from a selected window to enable a player to view into said basin through said selected window; and seeing if said one of said search objects is visible through said selected window.

17. The method according to claim 16, wherein said step of randomly selecting one of said search objects includes selecting a card from a deck of cards, wherein each card in said deck of cards identifies at least one of said search objects.

18. The method according to claim 17, further including the step of having a player keep said card should one of said search objects identified by said card be visible in said basin through said window.

* * * * *